US006006512A

United States Patent [19]

Schmid

[11] Patent Number: 6,006,512

[45] Date of Patent: Dec. 28, 1999

[54] ROTOR CUP FOR OPEN-END SPINNING AND METHOD OF MAKING SAME

[75] Inventor: Friedbert Schmid, Bad Überkingen, Germany

[73] Assignee: Spindelfabrik Suessen, Schurr, Stahlecker & Grill GmbH, Suessen, Germany

[21] Appl. No.: 09/115,345

[22] Filed: Jul. 15, 1998

[30] Foreign Application Priority Data

Aug. 8, 1997 [DE] Germany ..... 197 34 426
Jun. 10, 1998 [DE] Germany ..... 198 25 906

[51] Int. Cl.[6] ..... D01H 4/00
[52] U.S. Cl. ..... 57/414; 57/416
[58] Field of Search ..... 57/404, 414, 416

[56] References Cited

U.S. PATENT DOCUMENTS 4,193,253 3/1980 Herbert et al. ..... 57/414
4,358,922 11/1982 Feldstein ..... 57/414
4,358,923 11/1982 Feldstein ..... 57/414
4,547,407 10/1985 Spencer ..... 427/367
4,662,170 5/1987 Raasch ..... 57/416
4,866,927 9/1989 Fetzer et al. ..... 57/416

FOREIGN PATENT DOCUMENTS

4305626A1 8/1994 Germany .
1389244 2/1972 United Kingdom .
2104111 3/1983 United Kingdom ..... 57/404

*Primary Examiner*—William Stryjewski
*Attorney, Agent, or Firm*—Evenson McKeown Edwards & Lenahan, PLLC

[57] ABSTRACT

In the case of a rotor cup for open-end spinning aggregates, a smooth fiber sliding surface and a rough-surfaced fiber collecting groove are provided. By means of two separate plating processes, the fiber collecting groove is provided with a nickel-diamond plating and the fiber sliding surface is provided with a purely nickel plating.

16 Claims, 2 Drawing Sheets

ROTOR CUP FOR OPEN-END SPINNING AND METHOD OF MAKING SAME

BACKGROUND AND SUMMARY OF THE INVENTION

This application claims the priority of German application 197 34 426.7, filed in Germany on Aug. 8, 1997 and German application 198 25 906.9, filed in Germany on Jun. 10, 1998, the disclosures of which are expressly incorporated by reference herein.

The present invention relates to a rotor cup for open-end spinning aggregates comprising a rough-surfaced fiber collecting groove in relation to the fibers to be spun, which fiber collecting groove is provided with a nickel plating containing diamond grains, said rotor cup also comprising a smooth fiber sliding surface in relation to the fibers, which is provided with a nickel plating without diamond grains.

German published patent application 43 05 626 discloses that the fiber collecting groove, in relation to the fibers, should have a greater friction resistance than the fiber sliding surface. This, on the one hand, permits the fibers to slip sufficiently easily into the fiber collecting groove in the case of relatively steep fiber sliding surfaces of spinning rotors with small diameters, while on the other hand it is ensured that the fibers take on the circumferential speed of the spinning rotor at the latest at the fiber collecting groove. All the surfaces of the rotor cup are completely covered with a nickel-diamond plating. The desired roughness in the fiber collecting groove comes about in the known spinning rotor in that individual diamond grains project out from the plating. The fiber sliding surface is, in contrast, subsequently smoothed, whereby a large percentage of the diamond grains are pulled out, by means of which the fiber sliding surface loose the undesired gripping effect. This method has a disadvantage in that costly diamond particles are applied to the entire surface of the rotor cup and then subsequently removed, at least on the area of the fiber sliding surface, as their function is not required in this area.

It is an object of the present invention to plate a rotor cup of the above mentioned type in such a way that from the very beginning, diamond particles are applied only where they are actually required.

This object has been achieved in accordance with the present invention in that two nickel platings are applied in two separate plating processes.

As it was assumed up to now that it was not possible to provide only the fiber collecting groove with a nickel-diamond plating, as the plating process is applied in a single bath, the process according to the present invention nevertheless enables the diamond particles to be applied only in the fiber collecting groove. It is hereby practical when the diamond grains of the nickel plating on the fiber collecting groove have a grain size of 4 $\mu$m.

For the purpose of the present invention, the plating process is carried out in the following stages:

Firstly, the entire rotor cup is chemically nickel-plated, whereby the desired plating is created on the fiber sliding surface, and a corrosion protection is created on all surfaces of the rotor cup, also on parts which the fibers do not actually reach. Next, the fiber collecting groove is covered with a removable insert, which is designed, for example, as an elastically flexible plastic mask. Thereafter, the entire rotor cup can be lowered into a bath of protective coating, for example, liquid wax, whereby the removable insert prevents the protective coating from entering the fiber collecting groove. When the insert is removed from the fiber collecting groove, the entire remaining contour of the rotor cup, already nickel-plated, is covered with a protective coating. Thus the rotor cup can now be provided with a nickel-diamond plating in a bath, whereby this nickel-diamond plating is applied only to the fiber collecting groove, namely on the already present, previously applied nickel plating. Thus the costly diamond particles are only applied where they are later actually required. When finally the protective coating is removed from the remaining contours of the rotor cup, the result is a rotor cup in which the fiber collecting groove is provided with a rough nickel-diamond plating and the fiber sliding surface is provided with a smooth, purely nickel plating. As the nickel plating also covers the outer contours of the rotor cup, additional protection against corrosion is achieved.

The nickel plating need not, of course, consist of pure nickel; a nickel alloy is also possible in this case.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
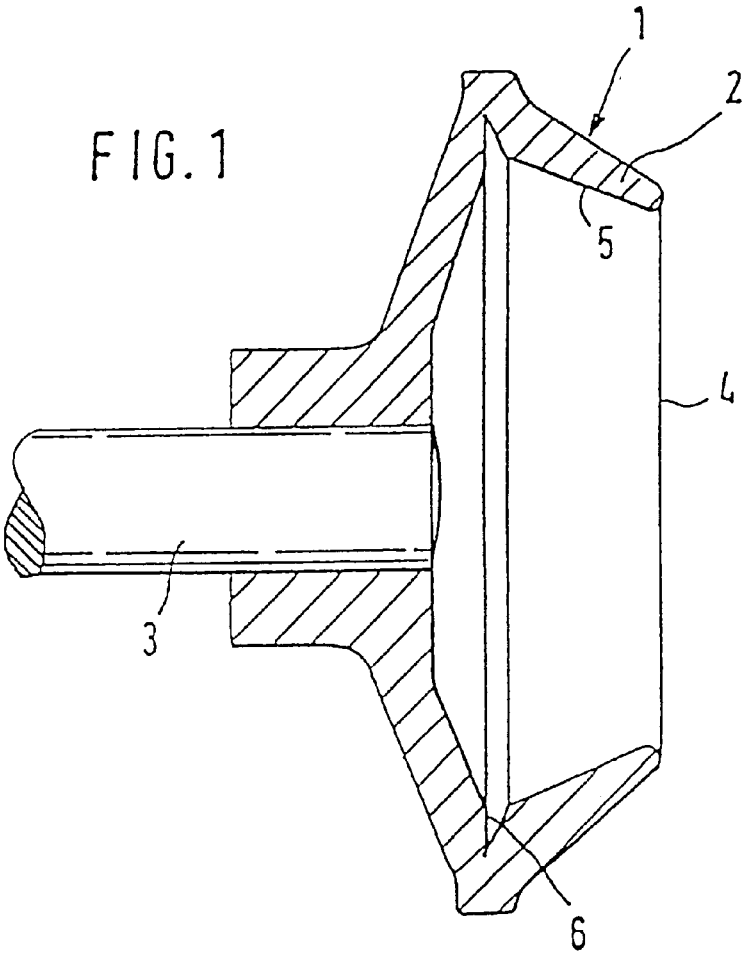
FIG. 1 is a sectional view of an enlarged rotor cup for practical spinning rotors of the type contemplated by the present invention.

The open-end spinning rotor 1 shown in FIG. 1 comprises in a known way a rotor cup 2 and a shaft 3 fixedly connected thereto. The open front side 4 of the rotor cup 2 faces the service side of the open-end spinning aggregate and is closed during operation by a cover (not shown).

During operation, the fibers to be spun are fed through the open front side 4 by means of a fiber feed channel (not shown) to a fiber sliding surface 5 of the rotor cup 2. Thereon the fibers slide under the action of centrifugal forces into a fiber collecting groove 6, which has its largest diameter in the inner area of the rotor cup 2.

In order that in the case of relatively steep fiber sliding surfaces 5 the fibers reliably reach the fiber collecting groove 6, the fiber sliding surface 5 should be designed to be as smooth as possible. In the fiber collecting groove 6, in contrast, the fibers should take on the circumferential speed of the rotor cup 2 when possible without slip. For this reason, the fiber collecting groove 6 is, relative to the fibers, designed with a rough surface for gripping.

Figure 2:
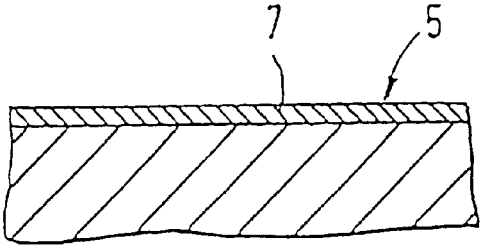
FIG. 2 is a greatly enlarged section of FIG. 1 in the area of the fiber sliding surface of the rotor cup.

The different friction ratios of the fiber sliding surface 5 and the fiber collecting groove 6, both relative to the fibers, are achieved in that the fiber collecting groove 6 is provided with a nickel-diamond plating 8 (see FIG. 3) and the fiber sliding surface 5 is provided with a nickel plating 7 without diamond grains 9 (see FIG. 2). The entire inner and outer contours of the rotor cup 2 are first provided with the nickel plating 7, although it is only the fiber sliding surface 5 which requires this plating for its function. The nickel plating 7 forms a protection against corrosion on the remaining surfaces. The nickel-diamond plating 8, which has diamond grains 9 in the order of magnitude of preferably 4 $\mu$m, is subsequently applied to the nickel Plating 7, but only in the fiber collecting groove 6.

Figure 4A:
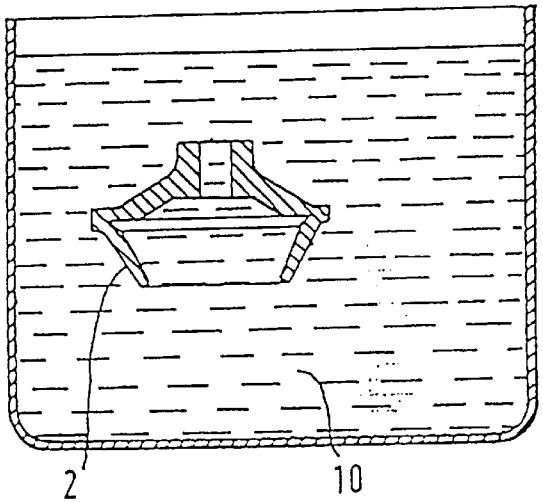
FIGS. 4A to 4F show a schematic sequence of the individual procedural steps during plating.

The separate plating processes according to the present invention are realized in the following procedural stages:

The steel alloy rotor cup 2 is first provided by means of hydrous solution 10 in a currentless way with a nickel plating (see FIG. 4A). The nickel plating 7 is usually deposited at 90° C.

Figure 4B:
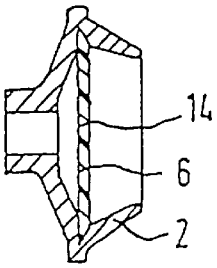

FIG. 4B shows the completely chemically nickel-plated rotor cup 2. As subsequently the fiber collecting groove 6 is to be provided with a nickel-diamond plating 8, the fiber collecting groove 6 is first covered by a removable insert 14. This insert 14 can be a radially elastic resilient plastic mask, which is located only in the fiber collecting groove 6 and which can be formed accordingly for application. The contour of the insert 14 is adapted to the contour of the fiber collecting groove 6.

Figure 4C:
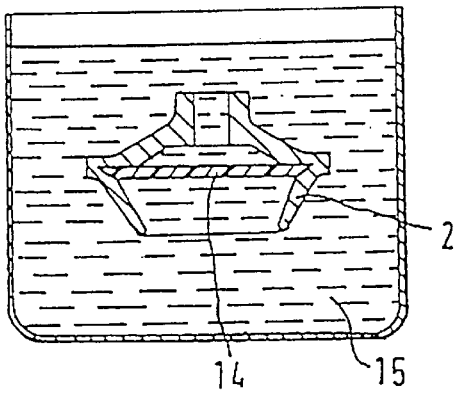

The rotor cup 2, provided in this way with an insert 14, can now be provided with a temporary protective coating (FIG. 4C). In order to achieve this, the rotor cup 2 is lowered into a liquid bath 15, which can, for example, consist of liquid wax. All the surfaces of the rotor cup 2, with the exception of the fiber collecting groove 6, are hereby covered.

Figure 4E:
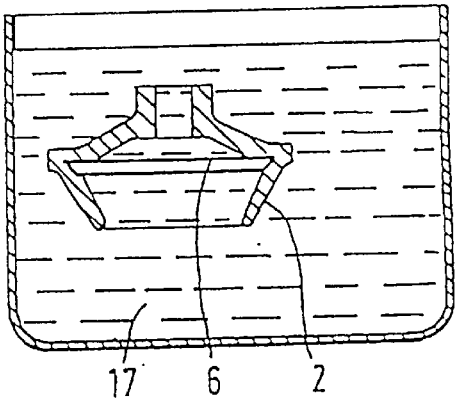
Figure 4D:
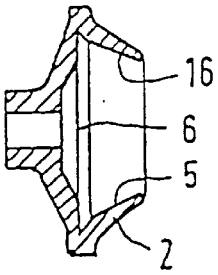

FIG. 4D shows the rotor cup 2, which is provided on all its surfaces, in particular on the fiber sliding surface 5, with a protective coating 16 (for example wax). This protective coating 16 is denoted by thick lines. Only the fiber collecting groove 6 is free of this protective coating 16, which is denoted by thinner lines.

Figure 3:
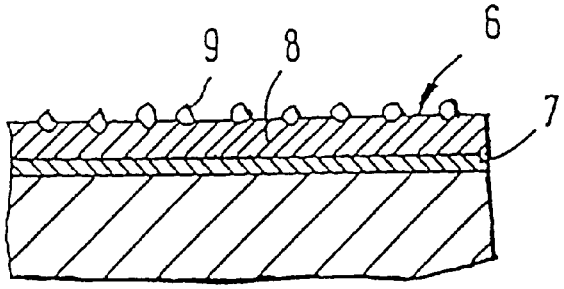
FIG. 3 is a greatly enlarged section of FIG. 1 in the area of the fiber collecting groove of the rotor cup.

It is now possible to provide only the fiber collecting groove 6 of the rotor cup 2 in the desired way with the nickel-diamond plating 8 (see FIG. 3). This procedural step is shown in FIG. 4E. The rotor cup 2, provided with the protective coating 16, is lowered into a hydrous solution, which is composed so that the diamond grains are embedded during currentless plating. This plating process is generally known and does not need further explanation here. Due to the previously applied protective coating 16, only the fiber collecting groove 6 is now provided with a nickel-diamond plating 8.

Figure 4F:
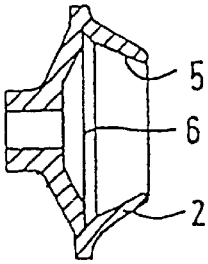

FIG. 4F shows the finished rotor cup 2, which—after the protective coating 16 has been subsequently removed—corresponds to FIG. 1, that is, the fiber collecting groove 6 is provided with a nickel-diamond plating 8 with a gripping effect and the smooth fiber sliding surface 5 is provided with a nickel plating 7.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A rotor cup for open-end spinning aggregates comprising a fiber collecting groove having a grip effect relative to the fibers to be spun, which fiber collecting groove is provided with a first nickel plating containing diamond grains, said rotor cup also comprising a smooth fiber sliding surface relative to the fibers, which fiber sliding surface is provided with a second nickel plating without diamond grains, wherein the first and second nickel platings are applied in two separate plating processes.

2. A rotor cup according to claim 1, wherein the diamond grains of the first nickel plating on the fiber collecting groove have a grain size of approximately 4 $\mu$m.

3. A process for plating a rotor cup for open-end spinning aggregates comprising a fiber collecting groove having a grip effect relative to the fibers to be spun, which fiber collecting groove is provided with a nickel plating containing diamond grains, said rotor cup also comprising a smooth fiber sliding surface relative to the fibers, which fiber sliding surface is provided with a nickel plating without diamond grains, said processing comprising the following sequential steps:

chemically nickel plating the rotor cup, providing a removable protective coating on the rotor cup with the exception of the fiber collecting groove, nickel-diamond plating the rotor cup fiber collecting groove, and removing the protective coating.

4. A process according to claim 3, wherein the fiber collecting groove is covered by a removable insert before the protective coating is applied, which insert is then removed before the nickel-diamond plating is applied.

5. A process according to claim 4, wherein wax is used for the protective coating.

6. A process according to claim 5, wherein a radially elastic flexible plastic inset is used for the removable insert.

7. A rotor cup made utilizing the process of claim 6.

8. A rotor cup made utilizing the process of claim 5.

9. A process according to claim 4, wherein a radially elastic flexible plastic inset is used for the removable insert.

10. A rotor cup made utilizing the process of claim 9.

11. A rotor cup made utilizing the process of claim 4.

12. A process according to claim 3, wherein wax is used for the protective coating.

13. A process according to claim 12, wherein a radially elastic flexible plastic inset is used for the removable insert.

14. A rotor cup made utilizing the process of claim 13.

15. A rotor cup made utilizing the process of claim 12.

16. A rotor cup made utilizing the process of claim 3.

* * * * *